US008262213B2

(12) United States Patent
Sugahara

(10) Patent No.: US 8,262,213 B2
(45) Date of Patent: Sep. 11, 2012

(54) LIQUID EJECTION APPARATUS

(75) Inventor: Hiroto Sugahara, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 346 days.

(21) Appl. No.: 12/645,454

(22) Filed: Dec. 22, 2009

(65) Prior Publication Data

US 2010/0156985 A1 Jun. 24, 2010

(30) Foreign Application Priority Data

Dec. 22, 2008 (JP) ..... 2008-325359

(51) Int. Cl.
*B41J 2/01* (2006.01)

(52) U.S. Cl. ..... 347/102

(58) Field of Classification Search ..... 347/5, 102–104, 347/16; 430/320
See application file for complete search history.

(56) References Cited

U.S. PATENT DOCUMENTS

| | | | | |
|---|---|---|---|---|
| 6,561,640 | B1 * | 5/2003 | Young | 347/102 |
| 7,444,060 | B2 * | 10/2008 | Yoda | 385/147 |
| 7,690,781 | B2 * | 4/2010 | Ohnishi | 347/102 |
| 7,837,319 | B2 * | 11/2010 | Rodin et al. | 347/102 |
| 2004/0227783 | A1 | 11/2004 | Kumamoto et al. | |
| 2007/0013757 | A1 | 1/2007 | Ohnishi | |
| 2008/0074484 | A1 | 3/2008 | Sugahara | |

FOREIGN PATENT DOCUMENTS

| | | | |
|---|---|---|---|
| JP | 2004-291567 | A | 10/2004 |
| JP | 2004-351709 | A | 12/2004 |
| JP | 2004-358769 | A | 12/2004 |
| JP | 2004-358953 | A | 12/2004 |
| JP | 2005-103849 | A | 4/2005 |
| JP | 2005-104019 | A | 4/2005 |
| JP | 2006-150633 | A | 6/2006 |
| JP | 2008-105403 | A | 5/2008 |

OTHER PUBLICATIONS

Japan Patent Office, Notice of Reasons for Rejection for Japanese Patent Application No. 2008-325359 (counterpart to above-captioned patent application), mailed Aug. 24, 2010.

* cited by examiner

*Primary Examiner* — An Do
(74) *Attorney, Agent, or Firm* — Baker Botts L.L.P.

(57) ABSTRACT

A liquid ejection apparatus includes: a liquid ejection head which ejects photo-curable liquid from a nozzle; a supporting member which supports, from a side opposite to the liquid ejection head, an ejection target to which the liquid is ejected from the liquid ejection head; a light applying apparatus which applies light for curing the liquid ejected from the liquid ejection head; and a control device which controls the liquid ejection head and the light applying apparatus. The control device controls the liquid ejection head and the light applying apparatus to execute: a liquid ejection mode in which the liquid is ejected from the liquid ejection head to the ejection target and the light is applied from the light applying apparatus to the ejection target; and a curing mode in which the light is directly applied from the light applying apparatus to the supporting member.

14 Claims, 10 Drawing Sheets

LIQUID EJECTION APPARATUS

CROSS REFERENCE TO RELATED APPLICATION

The present application claims priority from Japanese Patent Application No. 2008-325359, which was filed on Dec. 22, 2008, the disclosure of which is herein incorporated by reference in its entirety.

BACKGROUND OF THE INVENTION

1. Field of the Invention

The present invention relates to a liquid ejection apparatus which ejects photo-curable liquid from a nozzle.

2. Description of Related Art

A known inkjet printer is arranged as follows: an inkjet head moves in one direction along a guide rail and ejects UV-curable ink onto a print medium which is supported by a platen and conveyed by a feed roller in the direction orthogonal to said one direction, so that the ink impacts on the print medium and the deposited ink is cured by applying ultraviolet light to the ink from an ultraviolet light applying apparatus integrally formed with the inkjet head, with the result that printing on the print medium is completed.

SUMMARY OF THE INVENTION

Such an inkjet printer is disadvantageous in that, the ink ejection from the inkjet head is accompanied with problems such as ink mist and so-called satellite ink and hence ink unnecessarily adheres to the platen due to these problems, with the result that the ink adhered to the platen is transferred to the print medium. In connection with this, typically the UV-curable ink ejected from the inkjet head hardly dries up naturally, and hence the ink adhering to the platen is easily transferred to the print medium.

An object of the present invention is to provide a liquid ejection apparatus which is able to protect a target of liquid ejection from a liquid ejection head from the adhesion of photo-curable liquid which adheres to a supporting member supporting the ejection target.

Provided by the present invention is a liquid ejection apparatus including: a liquid ejection head which ejects photo-curable liquid from a nozzle; a supporting member which supports, from a side opposite to the liquid ejection head, an ejection target to which the liquid is ejected from the liquid ejection head; a light applying apparatus which applies light for curing the liquid ejected from the liquid ejection head; and a control device which controls the liquid ejection head and the light applying apparatus. The control device controls the liquid ejection head and the light applying apparatus to execute: a liquid ejection mode in which the liquid is ejected from the liquid ejection head to the ejection target supported by the supporting member and the liquid on the ejection target is cured by application of the light from the light applying apparatus to the ejection target; and a curing mode in which the light is directly applied from the light applying apparatus to the supporting member so that the liquid adhering to the supporting member is cured.

According to the present invention, the liquid adhering to the supporting member as a result of the execution of the liquid ejection mode is cured by the execution of the liquid curing mode in the liquid ejection apparatus. It is therefore possible to prevent the liquid adhering to the supporting member from being transferred to the ejection target.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

The following will describe a preferred embodiment of the present invention.

Figure 1A:
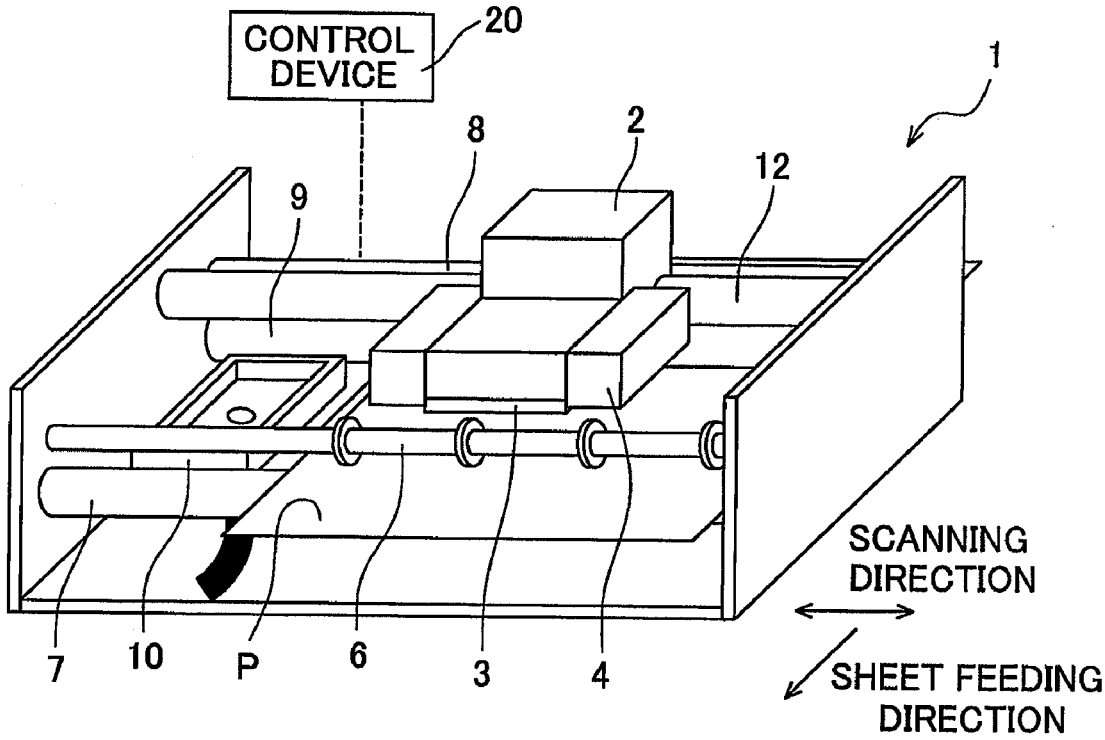
FIG. 1A is a schematic diagram of a printer of an embodiment of the present invention, when a print mode is being executed.
Figure 1B:
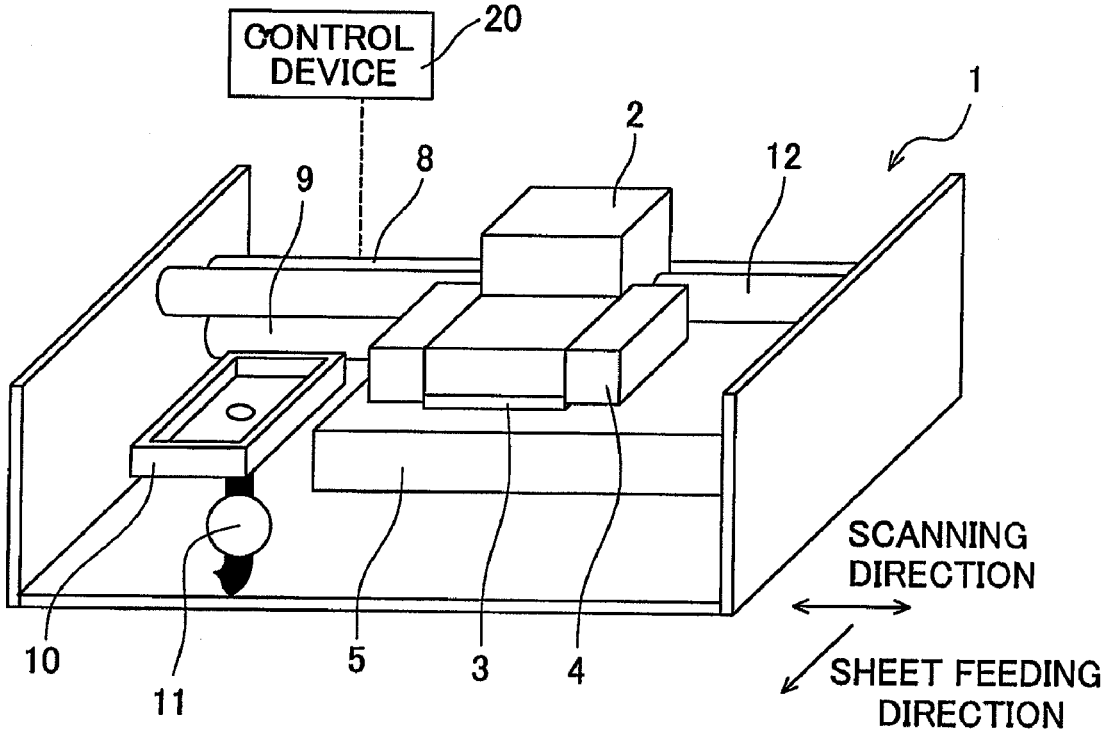
FIG. 1B is a schematic diagram of the printer of the embodiment of the present invention, when an ink curing mode is being executed.
Figure 2:
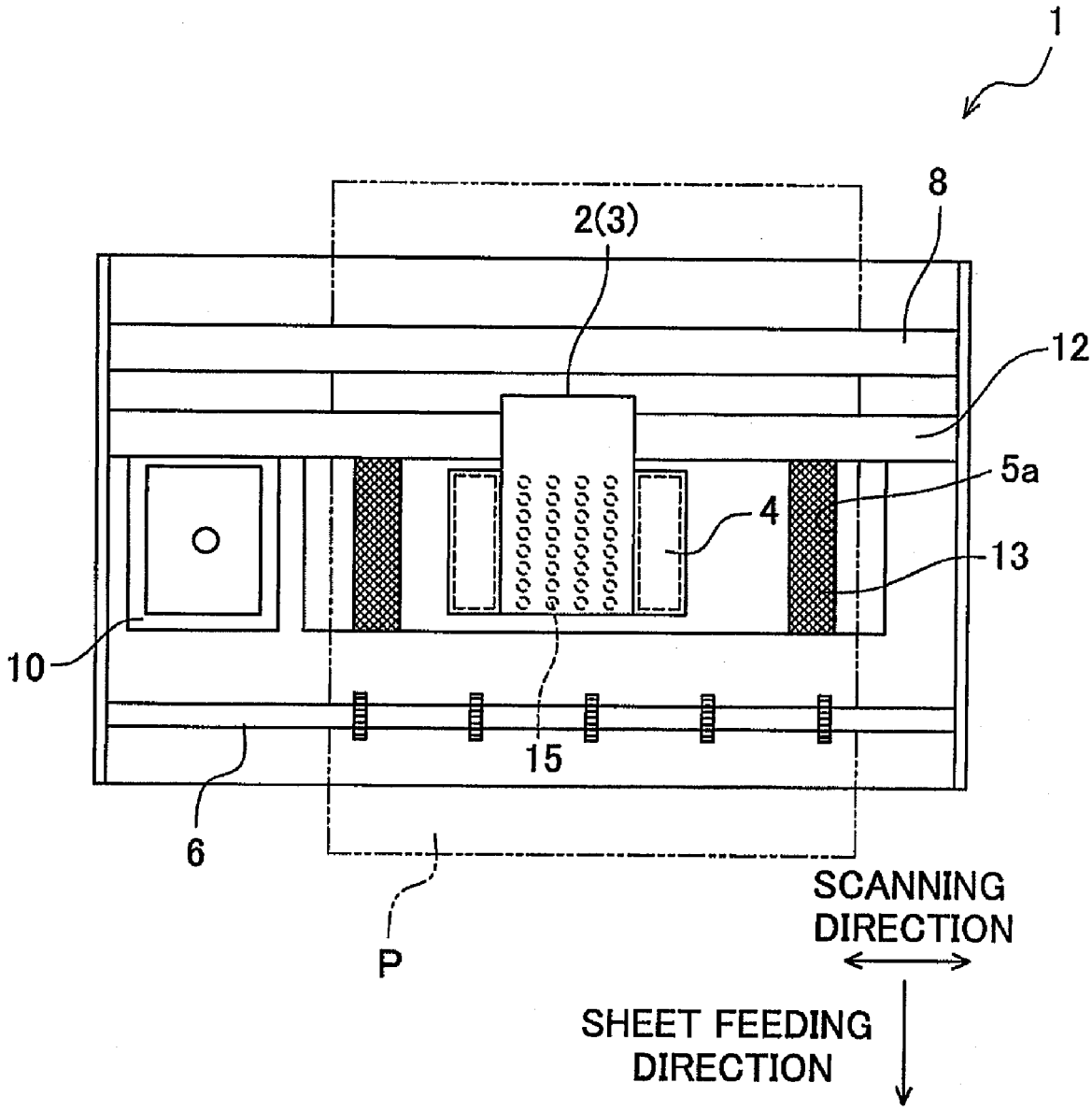
FIG. 2 is a plan view of FIGS. 1A and 1B.
Figure 3A:
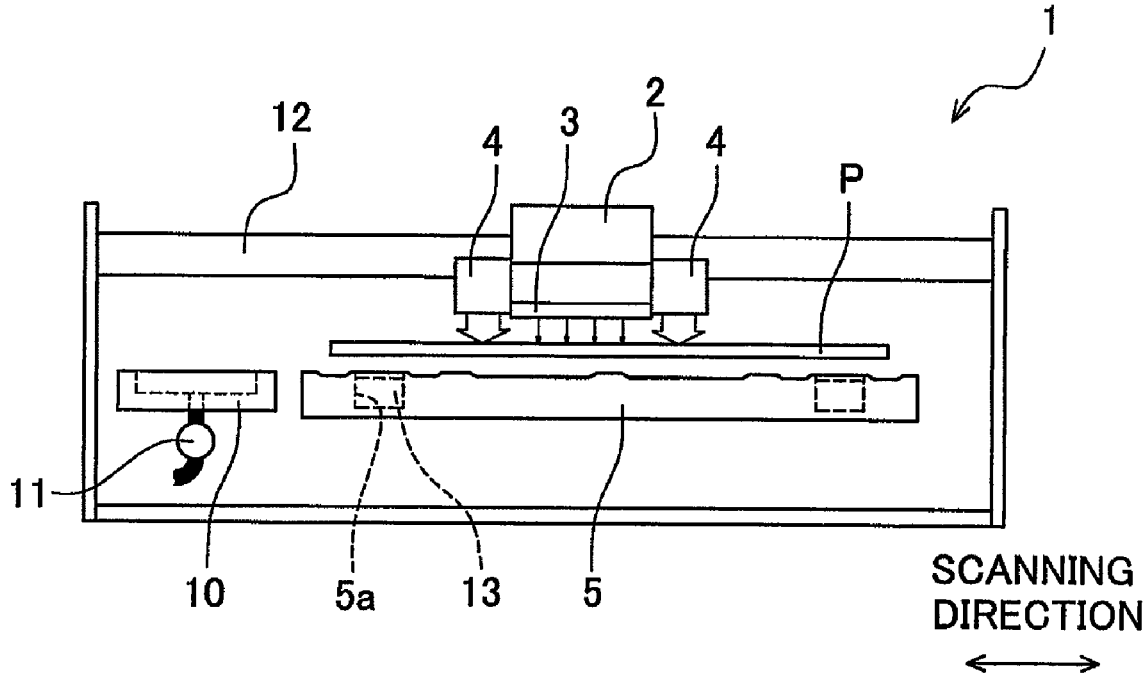
FIG. 3A is a drawing of the printer of FIG. 2 in the print mode, when viewed in the direction of the arrow III.
Figure 3B:
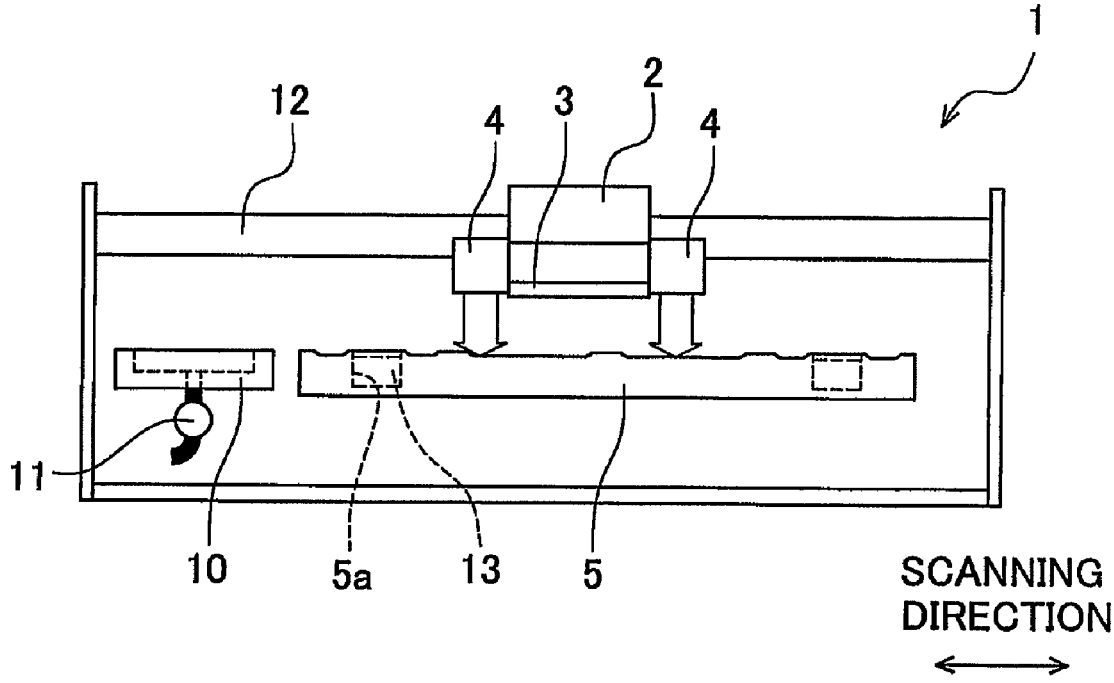
FIG. 3B is a drawing of the printer of FIG. 2 in the ink curing mode, when viewed in the direction of the arrow III.

FIG. 1A is a schematic diagram of a printer of the present embodiment when a later-described print mode is being executed. FIG. 1B is a schematic diagram of the printer of the present embodiment when a later-described ink curing mode is being executed. FIG. 2 is a plan view of FIGS. 1A and 1B. FIG. 3A is a drawing of the printer of FIG. 2 in the print mode, when viewed in the direction of the arrow III. FIG. 3B is a drawing of the printer of FIG. 2 in the ink curing mode, when viewed in the direction of the arrow III. In FIG. 1B, a later-described conveyor rollers 6 and 7 are not illustrated.

As shown in FIGS. 1A, 1B, 2, 3A, and 3B, a printer 1 which is a liquid ejection apparatus includes components such as a carriage 2, an inkjet head 3 which is a liquid ejection head, two ultraviolet light applying apparatuses 4 which are light applying apparatuses, a platen 5 which is a supporting member, conveyor rollers 6 to 9, a suction cap 10, and a pump 11. The operation of the printer 1 is controlled by a control device 20.

The carriage 2 reciprocates along a guide shaft 12 extending in a scanning direction which is a crosswise direction of FIGS. 1A and 1B. The inkjet head 3 is provided on the lower surface of the carriage 2, and ejects UV-curable ink which is photo-curable liquid from nozzles 15 formed on the lower surface to a record sheet P which is an ejection target. The two ultraviolet light applying apparatuses 4 sandwich the carriage 2 in the scanning direction, and apply ultraviolet light onto the record sheet P or the platen 5.

The platen 5 is provided below the carriage 2 to oppose the inkjet head 3 and the ultraviolet light applying apparatuses 4. From the lower side which is opposite to the side where the inkjet head 3 and the ultraviolet light applying apparatuses 4 are provided, the platen 5 supports the record sheet P to which ink is ejected from the inkjet head 3 and ultraviolet light is applied from the ultraviolet light applying apparatuses 4. The platen 5 has, as shown in FIG. 2 and FIGS. 3A and 3B, groove-shaped ink receivers 5*a* which are provided near the respective ends in the scanning direction and which extend in a sheet feeding direction which is in parallel to the vertical direction in FIG. 2. In each of the ink receivers 5*a* provided is an ink absorber 13. The conveyor rollers 6 to 9 convey, in the sheet feeding direction which is toward the viewer of FIG. 1A, the record sheet P which is supported by the platen 5.

The suction cap 10 is disposed to the left of the platen 5 in FIGS. 1A and 1B so that these components neighbor each other. The suction cap 10 is movable in the vertical direction. The suction cap 10 can therefore cover the nozzle surface of the inkjet head 3 after the suction cap 10 is moved upward while the inkjet head 3 is positioned to oppose the suction cap 10.

The pump 11 is connected to the suction cap 10. The suction cap 10 and the pump 11 are provided to perform later-described purging.

Figure 4:
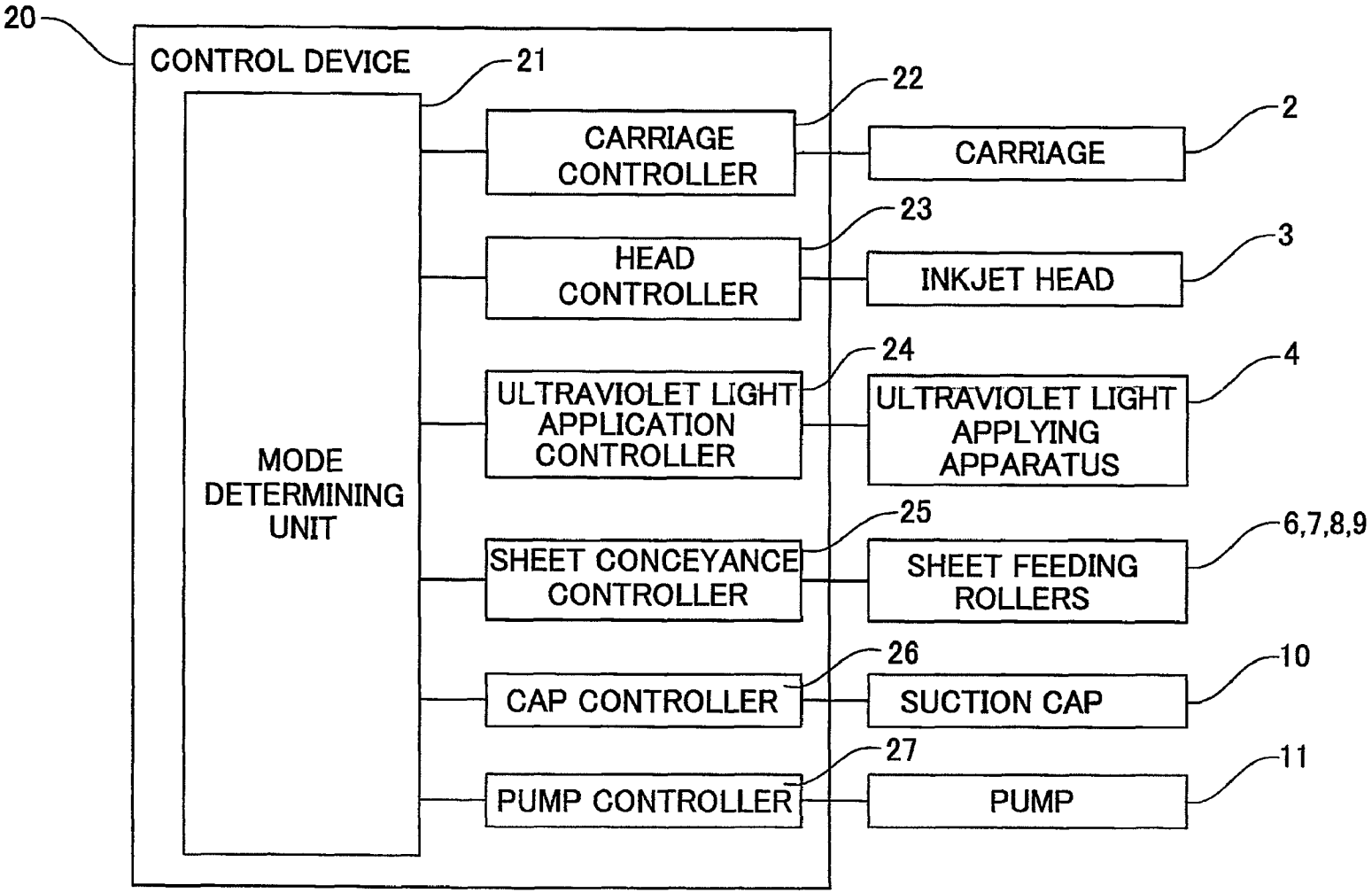
FIG. 4 is a block diagram of the control device of FIGS. 1A and 1B.

Now, the control device 20 which controls the operation of the printer 1 will be described. FIG. 4 is a block diagram of the control device 20. The control device 20 is made up of components such as a CPU (Central Processing Unit), a ROM (Read Only Memory), and a RAM (Random Access Memory), and these components function as a mode determining unit 21, a carriage controller 22, a head controller 23, an ultraviolet light application controller 24, a sheet conveyance controller 25, a cap controller 26, and a pump controller 27.

As described later, the printer 1 is arranged to be able to execute a print mode in which printing on a record sheet P is carried out, an ink curing mode in which ink on the platen 5 is cured, a flushing mode in which flushing is carried out, and a purging mode in which purging is carried out. In the printer 1, the mode determining unit 21 determines which one of the modes, the print mode, the ink curing mode, the flushing mode, and the purging mode, is to be executed. In the present embodiment, the print mode is equivalent to a liquid ejection mode of the present invention and the ink curing mode is equivalent to a liquid curing mode of the present invention.

The carriage controller 22 controls the operation of the carriage 2 in cases such as the print mode, the ink curing mode, the flushing mode, or the purging mode. The head controller 23 controls the operation of the inkjet head 3 in cases such as the print mode, the ink curing mode, or the flushing mode.

The ultraviolet light application controller 24 controls the operation of the ultraviolet light applying apparatuses 4 in cases such as the print mode or the ink curing mode. The sheet conveyance controller 25 controls the operation of the conveyor rollers 6 to 9 in cases such as the print mode. The cap controller 26 and the pump controller 27 control the operations of the suction cap 10 and the pump 11, respectively, in cases such as the purging mode.

As the components 22-27 of the control device 20 control the carriage 2, the inkjet head 3, the ultraviolet light applying apparatuses 4, the conveyor rollers 6 to 9, the suction cap 10, and the pump 11, respectively, the printer 1 can execute the mode determined by the mode determining unit 21.

Now, the following will describe the operations of the printer 1 when the print mode, the ink curing mode, the flushing mode, and the purging mode are executed.

Described first is the operation of the printer 1 when the print mode is executed. When the print mode is executed in the printer 1, the control device 20 performs control so that the conveyor rollers 6 to 9 convey the record sheet P in the sheet feeding direction. When the record sheet P reaches the position opposing the carriage 2, the carriage 2 reciprocates in the scanning direction and the inkjet head 3 which reciprocates with the carriage 2 in the scanning direction ejects ink onto the record sheet P. Furthermore, the ultraviolet light applying apparatuses 4 which also move with the carriage 2 in the scanning direction cure the ink deposited on the record sheet P by applying ultraviolet light thereto. In this way, printing on the record sheet P is carried out. During the operations above, the record sheet P is supported by the platen 5.

In connection with the above, since the ultraviolet light applying apparatuses 4 are provided on the respective sides of the inkjet head 3 in the scanning direction, the ultraviolet light applying apparatus 4 upstream of the movement direction of the carriage 2 applies ultraviolet light and hence the ink deposited onto the record sheet P is immediately cured. This makes it possible to cure the ink before it permeates into the record sheet P, thereby preventing the edge of the printed image from being blurred.

Figure 5B:
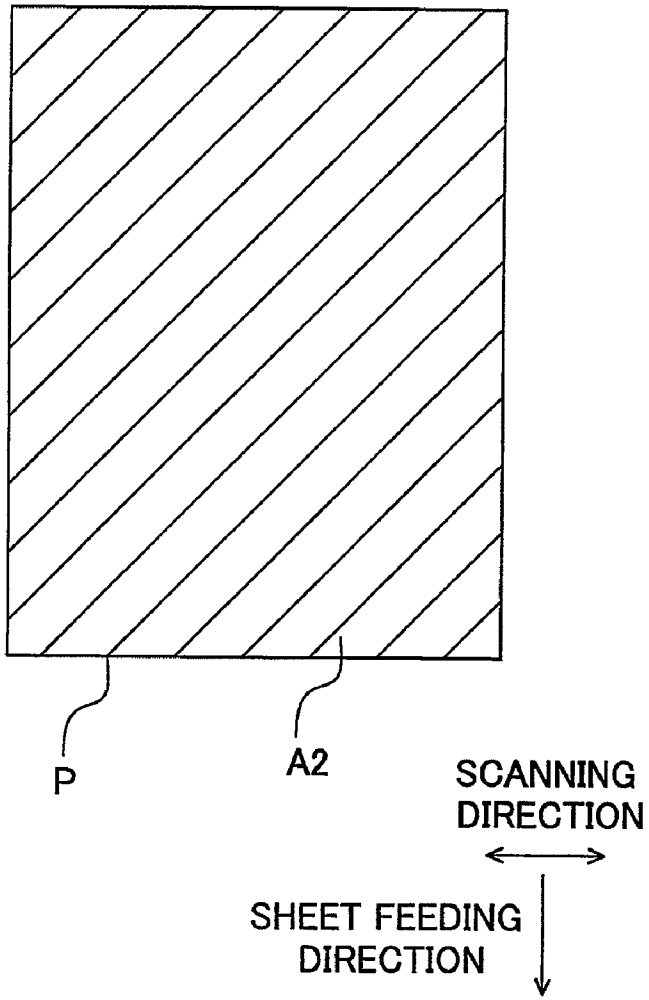
FIG. 5B shows an area of a record sheet to which area ink is ejected in a second print mode.
Figure 5A:
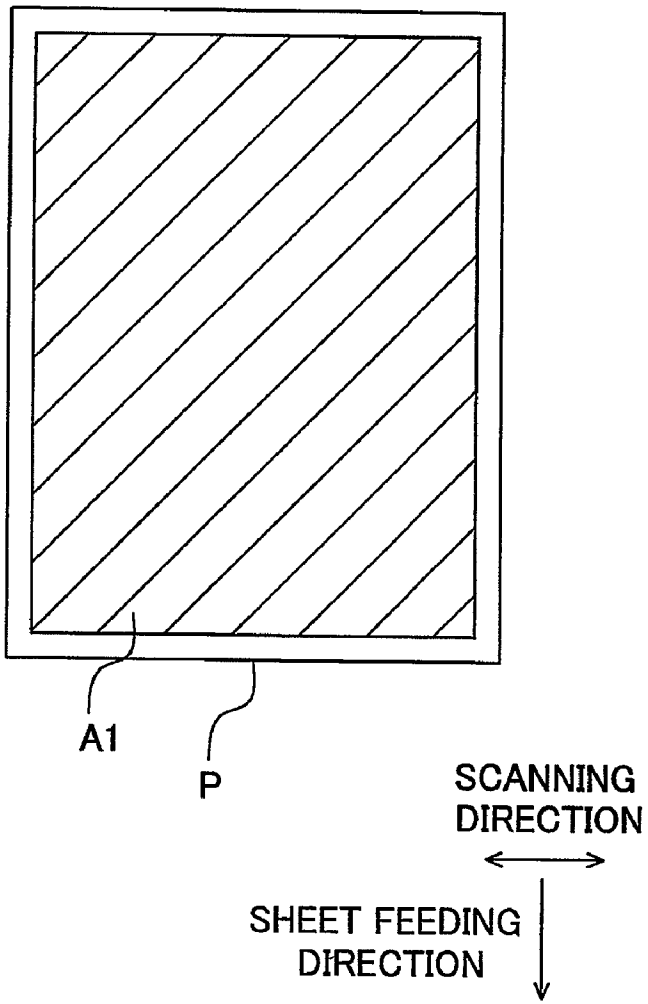
FIG. 5A shows an area of a record sheet to which area ink is ejected in a first print mode.

In addition to the above, in the present embodiment the followings can be executed as the aforesaid print mode: a first print mode in which, as shown in FIG. 5A, printing is carried out by causing the inkjet head 3 to eject ink only onto an area A1 excluding the frame portion of the record sheet P; and a second print mode in which, as shown in FIG. 5B, printing is carried out by causing the inkjet head 3 to eject ink onto an entire area A2 which includes the frame portion of the record sheet P. In the present embodiment, the first print mode and the second print mode correspond to a first liquid ejection mode and a second liquid ejection mode of the present invention, respectively.

Both in the first print mode and the second print mode, the carriage 2, the inkjet head 3, the ultraviolet light applying apparatuses 4, and the sheet feeding rollers 6 to 9 are operated as described above. However, in the first print mode, the inkjet head 3 does not eject ink when the inkjet head 3 is at the position opposing the frame portion of the record sheet P. On the other hand, in the second print mode, the inkjet head 3 ejects ink even when the inkjet head 3 is at the position opposing the frame portion of the record sheet P. The first print mode and the second print mode are different from each other only in this point.

Now, the operation of the printer 1 when the ink curing mode is executed will be described. When the ink curing mode is executed in the printer 1, the control device 20 performs control so that, while no record sheet P is provided on the platen 5, the carriage 2 reciprocates in the scanning direction and the ultraviolet light applying apparatuses 4 reciprocating with the carriage 2 in the scanning direction directly apply ultraviolet light onto the platen 5. When the ultraviolet light applying apparatuses 4 reach the position opposing the ink receiver 5*a*, the application of ultraviolet light from the ultraviolet light applying apparatuses 4 is discontinued so that no ultraviolet light is applied to the ink receiver 5*a*.

When the print mode is executed in the printer 1 as described above, the ink ejection from the inkjet head 3 may be accompanied with problems such as the generation of ink mist and the ejection of so-called satellite ink which occurs when ink to impact onto the record sheet P is ejected from the nozzles 15, and such unnecessarily-ejected ink may adhere to the surface of the platen 5. As a result, the ink adhering to the surface of the platen 5 may be transferred to the lower surface of the record sheet P and contaminate the same.

In particular, since the ink ejected from the inkjet head 3 and adhering to the surface of the platen 5 is UV-curable, it hardly dries up naturally and easily adheres to the record sheet P.

In this regard, the present embodiment is arranged so that the ink curing mode is executed for example after the execution of the print mode, and hence the ink adhering to the surface of the platen 5 is cured. This makes it possible to prevent the ink from adhering to the record sheet P.

In addition to the above, when the aforesaid second print mode is executed in the printer 1, in some cases ink is ejected so that a part of the ink flies beyond the boundary of the record sheet P in order to ensure the deposition of the ink onto the frame portion of the record sheet P. In such a case, the ink beyond the boundary of the record sheet P adheres to the platen 5.

In this regard, the present embodiment is arranged so that, after printing on the record sheet P is carried out by the second print mode, the traveling speed of the carriage 2 while the ink curing mode is executed to cure the ink on the platen 5 is decreased as compared to the speed after the printing onto the record sheet P by the first print mode.

As a result, the platen 5 after the printing onto the record sheet P by the second print mode is exposed to ultraviolet light for a longer period of time than the case after the printing onto the record sheet P is carried out by the first print mode, and hence an amount of ultraviolet light applied to the platen 5 is large.

To put it differently, the present embodiment has two ink curing modes, namely, a first ink curing mode by which the ink adhering to the platen 5 as a result of the execution of the first print mode is cured and a second ink curing mode by which the ink adhering to the platen 5 as a result of the execution of the second print mode is cured. Comparing the first and second ink curing modes, the time of application of ultraviolet light from the ultraviolet light applying apparatuses 4 to the platen 5 is longer in the second ink curing mode than in the first ink curing mode, i.e. an amount of light applied to the platen 5 is larger in the second ink curing mode than in the first ink curing mode.

As such, the second ink curing mode in which the time of application of ultraviolet light onto the platen 5 is long is executed after the execution of the second print mode in which ink tends to adhere to the platen 5, and hence the ink on the surface of the platen 5 is certainly cured.

In the meanwhile, after the first print mode in which ink does not easily adhere to the platen 5, the first ink curing mode is executed in which the time of application of ultraviolet light onto the platen 5 is short. This makes it possible to reduce the power consumption of the ultraviolet light applying apparatuses 4.

Now, the operation of the printer 1 when the flushing mode is executed will be described. When the flushing mode is executed in the printer 1, the control device 20 moves the carriage 2 so that the inkjet head 3 opposes the ink receiver 5*a*, and causes the inkjet head 3 at this position to eject ink onto the ink receiver 5*a*. This is the operation of flushing by which thickened ink or the like is ejected from the nozzles 15 and absorbed by the ink absorber 13.

As a case different from the present embodiment, consider a case where ultraviolet light is applied to the ink receiver 5*a* while the aforesaid ink curing mode is executed. In this case, the ink absorber 13 in the ink receiver 5*a* is exposed to ultraviolet light and hence the ink absorbed by the ink absorber 13 is cured, with the result that the ink absorber 13 cannot absorb ink any more. In this regard, the present embodiment can prevent the problem above because ultraviolet light is not applied to the ink absorber 13 when the ink curing mode is executed, as described above.

Now the operation of the printer 1 when the purging mode is executed will be described. When the purging mode is executed in the printer 1, the control device 20 moves the carriage 2 to the position where the inkjet head 3 opposes the suction cap 10. The suction cap 10 at this position is then moved upward so that the nozzle surface of the inkjet head 3 is covered by the suction cap 10, and thereafter the pump 11 is driven. As a result, purging is carried out so that thickened ink and foreign matters in the inkjet head 3 are sucked from the nozzles 15 through the suction cap 10. The sucked ink and foreign matters are stored in an unillustrated waste tank.

Now attention is turned to various kind of modifications of the present embodiment. It is noted that the same reference numerals are assigned to components having substantially identical arrangements as those of the present embodiment, and a repeated explanation is suitably avoided.

Figure 6A:
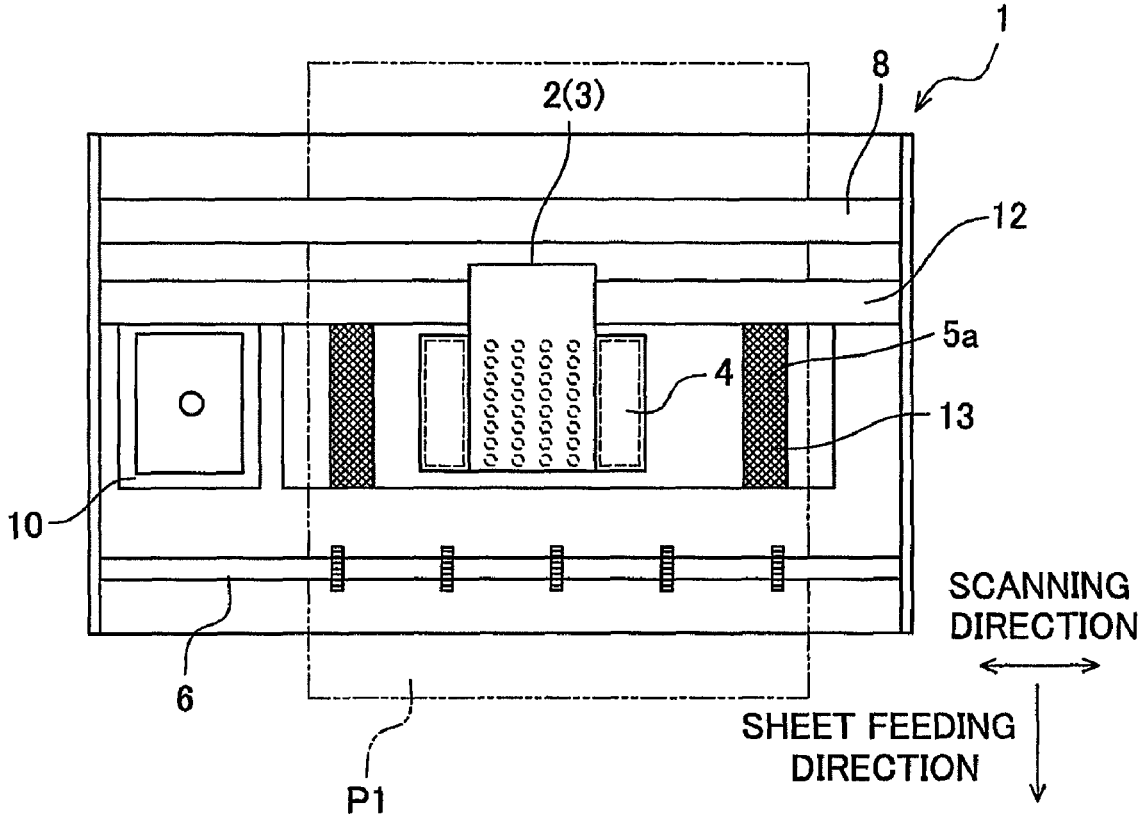
FIG. 6A is equivalent to FIG. 2 in a first print mode in a modification 1.
Figure 6B:
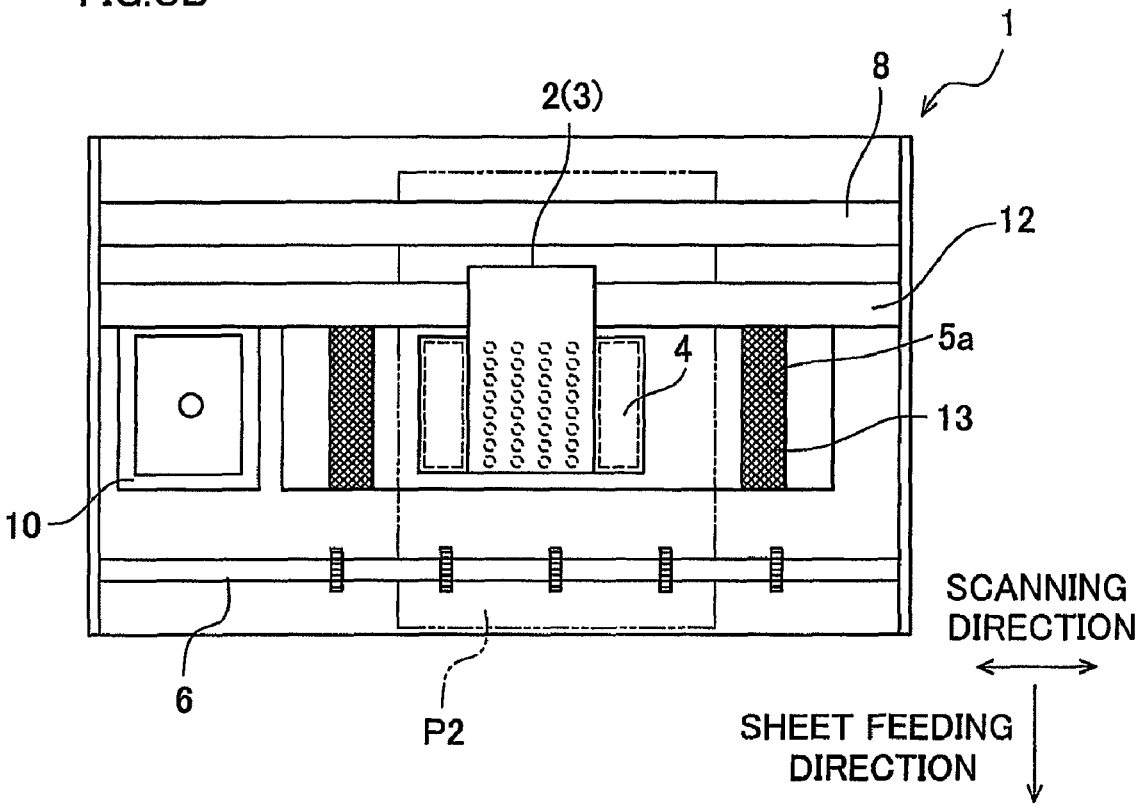
FIG. 6B is equivalent to FIG. 2 in a second print mode in the modification 1.

In one modification, the following print modes are executable in the printer 1: a first print mode shown in FIG. 6A in which ink is ejected from the inkjet head 3 onto a record sheet P1 which is similar to the record sheet P so that printing on the record sheet P1 is carried out; and a second print mode shown in FIG. 6B in which ink is ejected from the inkjet head 3 onto a record sheet P2 which is smaller in size than the record sheet P1 so that printing on the record sheet P2 is carried out.

After the printing on the record sheet P1 is carried out by the execution of the first print mode, a first ink curing mode similar to that of the embodiment above is executed so that the ink on the platen 5 is cured. After the printing on the record sheet P2 is carried out by the execution of the second print mode, a second ink curing mode similar to that of the embodiment above is executed so that the ink on the platen 5 is cured (modification 1).

In this case, as shown in FIG. 6A and FIG. 6B, an area of the platen 5 which area does not oppose the record sheet P2 and is exposed to the inkjet head 3 is larger in the second print mode than in the first print mode in the printer 1. Therefore ink tends to adhere to the platen 5 in the second print mode as compared to the first print mode.

In this regard, the modification 1 is arranged so that the second ink curing mode in which the time for applying ultraviolet light onto the platen 5 is long is executed after the execution of the second print mode in which ink tends to adhere to the platen 5. This makes it possible to surely cure the ink on the platen 5.

In the meanwhile, after the first print mode in which ink does not easily adhere to the platen 5, the first ink curing mode is executed in which the time of application of ultraviolet light onto the platen 5 is short. This makes it possible to reduce the power consumption of the ultraviolet light applying apparatuses 4.

Figure 7A:
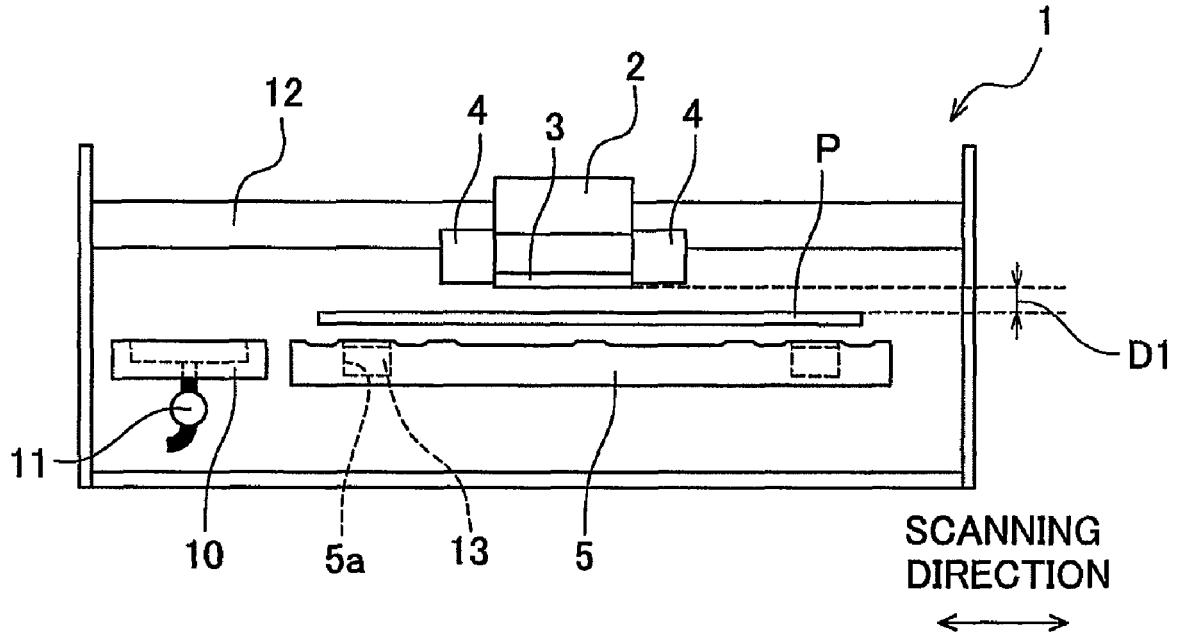
FIG. 7A is equivalent to FIG. 3A in a first print mode in a modification 2.
Figure 7B:
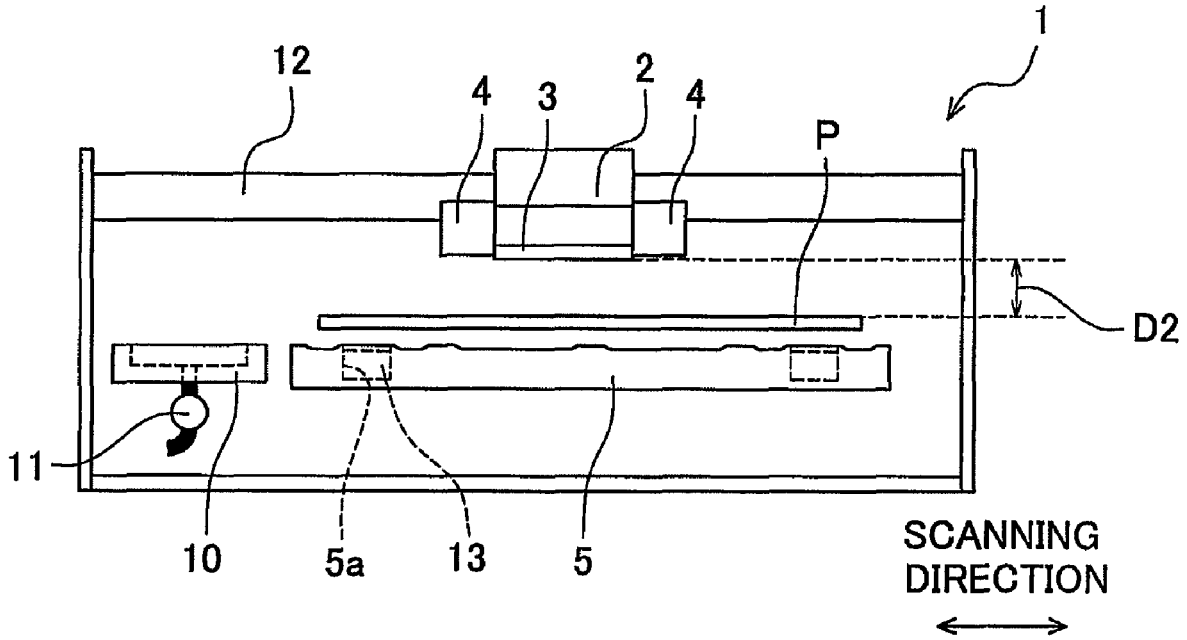
FIG. 7B is equivalent to FIG. 3A in a second print mode in the modification 2.

In another modification, the printer 1 is arranged so that the carriage 2 is vertically movable, i.e. the inkjet head 3 and the ultraviolet light applying apparatuses 4 supported by the carriage 2 are vertically movable. In the modification, furthermore, the following two print mode are executable: a first print mode shown in FIG. 7A in which the carriage 2 is vertically moved so that the distance between the inkjet head 3 and the record sheet P is adjusted to a predetermined distance D1, and printing on the record sheet P is carried out by ejecting ink from the inkjet head 3 at the position after the movement; and a second print mode shown in FIG. 7B in which the carriage 2 is vertically moved so that the distance between the inkjet head 3 and the record sheet P is adjusted to a distance D2 which is longer than the aforesaid distance D1, and printing on the record sheet P is carried out by ejecting ink from the inkjet head 3 after the movement.

After the printing on the record sheet P by the execution of the first print mode, a first ink curing mode similar to that of the embodiment above is executed so that the ink on the platen 5 is cured. On the other hand, after the printing on the record sheet P by the execution of the second print mode, a second ink curing mode similar to that of the embodiment above is executed so that the ink on the platen is cured.

Specific examples of the case where printing on the record sheet P is carried out by the execution of the first print mode are, for example, a case where deviation tolerance of ink ejection from the inkjet head 3 is small on account of high-definition printing and a case where the record sheet P is for example a glossy sheet and hardly warps and hence the record sheet P does not easily contacts the nozzle surface of the inkjet head 3 even if the inkjet head 3 is close to the record sheet P. In the meanwhile, specific examples of the case where printing on the record sheet P is carried out by executing the second print mode are a case where deviation tolerance of ink ejection from the inkjet head 3 is large on account of low-definition printing and a case where the record sheet P is for example a regular sheet and easily warps and hence the record sheet P easily contacts the nozzle surface of the inkjet head 3 when the inkjet head 3 is close to the record sheet P (modification 2).

In the modification 2, when the second print mode is executed, the distance between the inkjet head 3 and the record sheet P and the platen 5 is long as compared to the case of the first print mode, and hence the above-described satellite ink or the like tends to adhere, on the platen 5, to an area greatly deviated from the point which overlaps the nozzle 15 in plan view.

In this regard, the modification 2 is arranged so that the second ink curing mode in which the time for applying ultraviolet light onto the platen 5 is long is executed after the second print mode in which ink easily adheres to the platen 5. This makes it possible to certainly cure the ink on the platen 5.

In the meanwhile, after the first print mode in which ink does not easily adhere to the platen 5, the first ink curing mode is executed in which the time of application of ultraviolet light onto the platen 5 is short. This makes it possible to reduce the power consumption of the ultraviolet light applying apparatuses 4.

In the embodiment above, the traveling speed of the carriage 2 in the second ink curing mode is arranged to be slower than the speed in the first ink curing mode so that an amount of light applied to the platen 5 is large in the second ink curing mode. However, an amount of light may be increased in other ways. For example, the intensity of ultraviolet light applied from the ultraviolet light applying apparatuses 4 in the second ink curing mode is arranged to be higher than the intensity in the first ink curing mode so that an amount of ultraviolet light applied to the platen 5 is increased.

In the arrangement described above, two types of ink curing modes, namely the first ink curing mode and the second ink curing mode are executable corresponding to the first print mode and the second print mode. This arrangement, however, is not prerequisite.

For example, only one ink curing mode, e.g. either the first ink curing mode or the second ink curing mode is executable and the frequency of the execution of the ink curing mode is higher in the second print mode than in the first print mode. More specifically, when for example printing on the record sheets P or P1 is carried out by executing the first print mode, the ink curing mode is executed each time printing on a predetermined number of record sheets P or P1 is carried out. On the other hand, when printing on the record sheets P or P2 is carried out by executing the second print mode, the ink curing mode is executed each time printing on record sheets P or P2 whose number is fewer than the predetermined number is carried out.

Also in this case, by increasing the frequency of execution of the ink curing mode when the second print mode in which ink easily adheres to the platen 5 is executed, the ink adhering to the platen 5 is surely cured and hence the ink on the platen 5 does not adhere to the record sheet P or P2. In the meanwhile, when the first print mode in which ink does not easily adhere to the platen 5 is executed, the frequency of execution of the ink curing mode is lowered and hence the power consumption of the ultraviolet light applying apparatuses 4 is reduced.

In addition to the above, the embodiment above is arranged so that the ink absorber 13 is provided in the ink receiver 5*a* of the platen 5 and flushing is carried out by ejecting ink from the inkjet head 3 to the ink receiver 5*a*. This arrangement, however, is not prerequisite.

Figure 8:
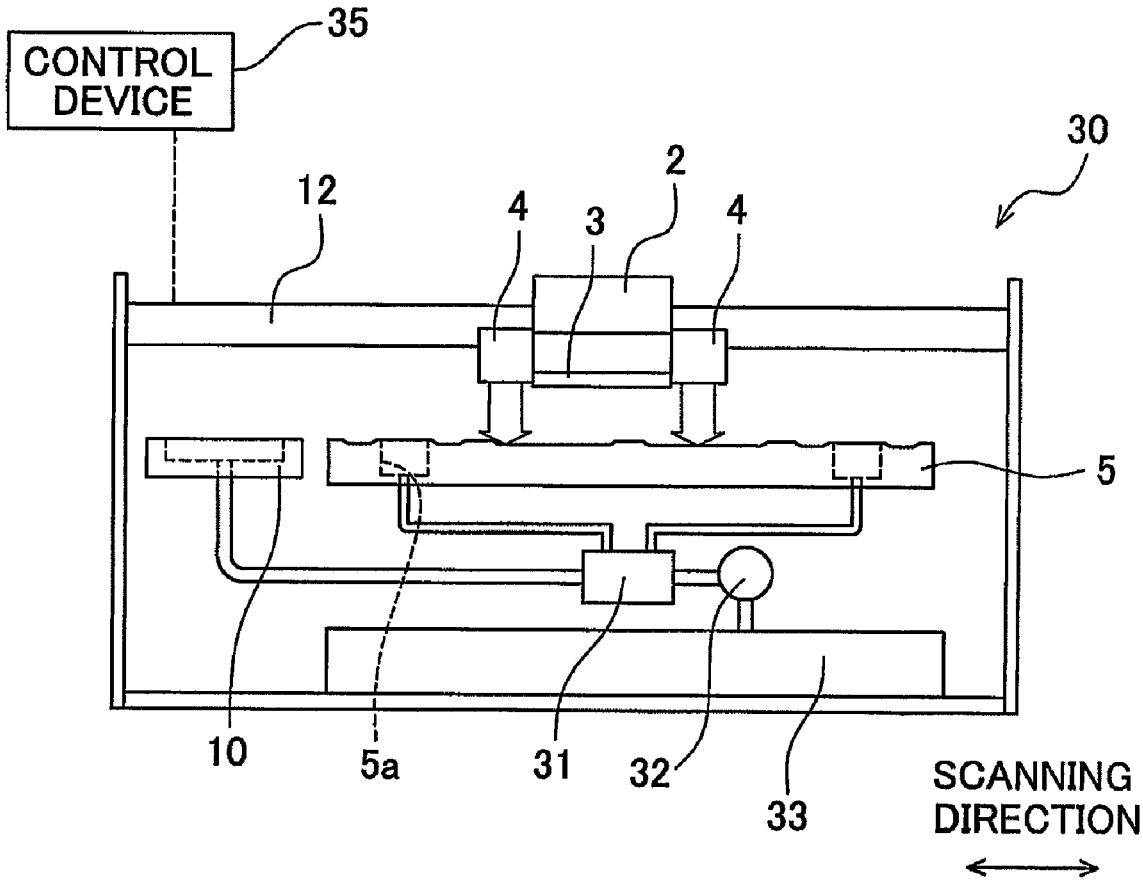
FIG. 8 is equivalent to FIG. 3B in a modification 3.

In a further modification, as shown in FIG. 8, a printer 30 is arranged so that no ink absorber 13 is provided in the ink receiver 5*a* and the ink receiver 5*a* is connected to a waste tank 33 via a switching unit 31 and a pump 32. The switching unit 31 is connected to the ink receiver 5*a* and the suction cap 10 and selectively connects the pump 32 with the ink receiver 5*a* or the suction cap 10.

The operation of the printer 30 is controlled by a control device 35. The control device 35 has, in the same manner as the control device 20 (see FIG. 4), a mode determining unit 21, a carriage controller 22, a head controller 23, a ultraviolet light application controller 24, a sheet conveyance controller 25, a cap controller 26, and a pump controller 27. In addition to them, the control device 35 has an unillustrated switching unit controller for controlling the switching unit 31.

When the purging mode is executed, the control device 35 controls the switching unit 31 to connect the suction cap 10 with the pump 32, and in this condition ink in the inkjet head 3 is sucked from the nozzles 15 via the suction cap 10 and supplied to the waste tank 33 in the same manner as the embodiment above.

On the other hand, when the flushing mode is executed, the control device 35 performs control so that, in the same manner as the embodiment above, ink is ejected from the inkjet head 3 to the ink receiver 5*a* and the switching unit 31 connects the ink receiver 5*a* with the pump 32, and in this condition the pump 32 is driven so that the ink in the ink receiver 5*a* is sucked and supplied to the waste tank 33.

Also in this case, the ink receiver 5*a* is arranged so as not to be exposed to ultraviolet light applied from the ultraviolet light applying apparatuses 4 in the ink curing mode, in the same manner as the embodiment above (modification 3).

Now, assume a case different from the modification 3 in that ultraviolet light is applied from the ultraviolet light applying apparatuses 4 to the ink receiver 5*a*. In this case, the ink in the ink receiver 5*a* is cured and the cured ink clogs the ink receiver 5*a*, the switching unit 31, the pump 32, and the waste tank 33, or the passages connecting them, with the result that the ink in the ink receiver 5*a* may not be sucked even if the pump 32 is driven while the switching unit 31 connects the ink receiver 5*a* with the pump 32.

In this regard, in the modification 3 no ultraviolet light is applied to the ink receiver 5*a* and hence the ink in the ink receiver 5*a* is not cured, with the result that the pump 32 can certainly suck the ink in the ink receiver 5*a*.

In the arrangement above, the inkjet head 3 is a so-called serial-type inkjet head which is supported by the carriage 2 and ejects ink while reciprocating with the carriage 2 in the scanning direction, and the ultraviolet light applying apparatuses 4 are supported by the carriage 2 and apply ultraviolet light while reciprocating with the carriage 2 in the scanning direction. This arrangement, however, is not prerequisite.

In yet another modification, as shown in FIG. 9, a printer 40 is arranged so that a belt 43 which is a supporting member is entrained around two conveyor rollers 41 and 42 which are substantially cylindrical and extend in the direction orthogonal to the plane of FIG. 9. As the conveyor rollers 41 and 42 rotate anticlockwise, the belt 43 rotates anticlockwise so that a record sheet P which is supported by the upper surface of the belt 43 is conveyed leftward in FIG. 9. In addition, an inkjet head 44 is provided to oppose the upper surface of the belt 43 and an ultraviolet light applying apparatus 45 is provided downstream of the inkjet head 44 in the direction of conveyance of the record sheet P by the belt 43, i.e. in the left part of FIG. 9. This inkjet head 44 is a so-called line-type head and extends substantially as long as the record sheet P conveyed by the belt 43, in the direction orthogonal to the plane of FIG. 9. The ultraviolet light applying apparatus 45 also extends substantially as long as the record sheet P in the direction orthogonal to the plane of FIG. 9.

The operation of the above-described printer 40 is controlled by a control device 46. The control device 46 includes, in the same manner as the control device 20 (see FIG. 4), a mode determining unit 21, a head controller 23, an ultraviolet light application controller 24, a sheet conveyance controller 25, and the like. The head controller 23 controls the operation of the inkjet head 44, the ultraviolet light application controller 24 controls the operation of the ultraviolet light applying apparatus 45, and the sheet conveyance controller 25 controls the operation of the conveyor rollers 41 and 42. The printer 40 is able to execute a print mode in which printing on a record sheet P is carried out and an ink curing mode in which ink adhering to the belt 43 is cured, under the control of the control device 46.

Figure 9A:
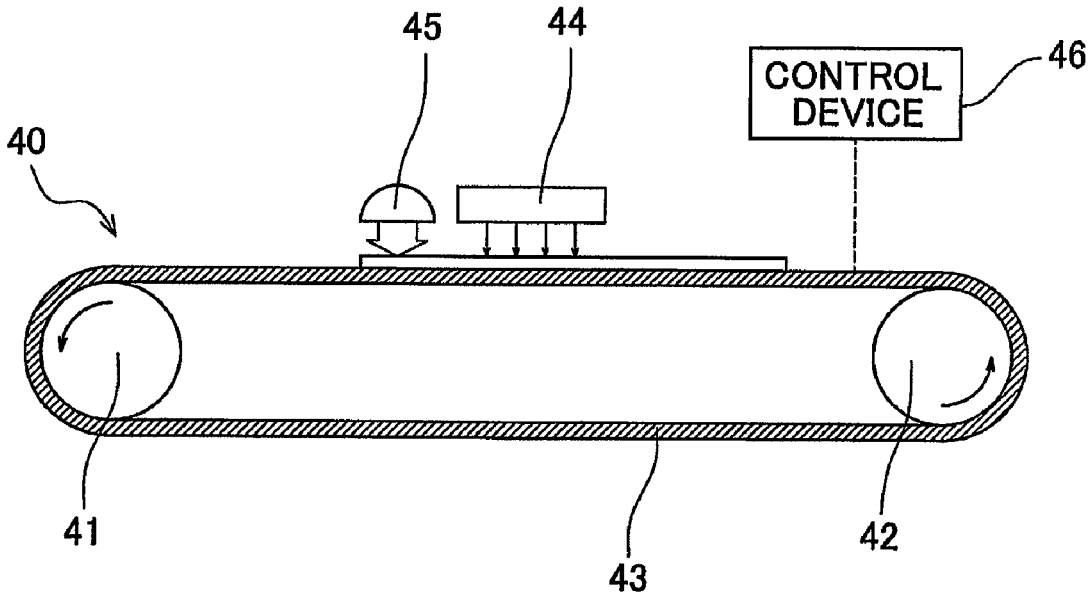
FIG. 9A is a schematic diagram of a printer in a print mode in a modification 4.

When the print mode is executed in the printer 40, the control device 46 performs control so that, as shown in FIG. 9A, a record sheet P is conveyed by the belt 43 which is rotated by the conveyor rollers 41 and 42. The inkjet head 44 ejects ink when the record sheet P reaches the position opposing the inkjet head 44, and the ultraviolet light applying apparatus 45 applies ultraviolet light when the record sheet P reaches the position opposing the ultraviolet light applying apparatus 45. In this way printing on the record sheet P is carried out.

Figure 9B:
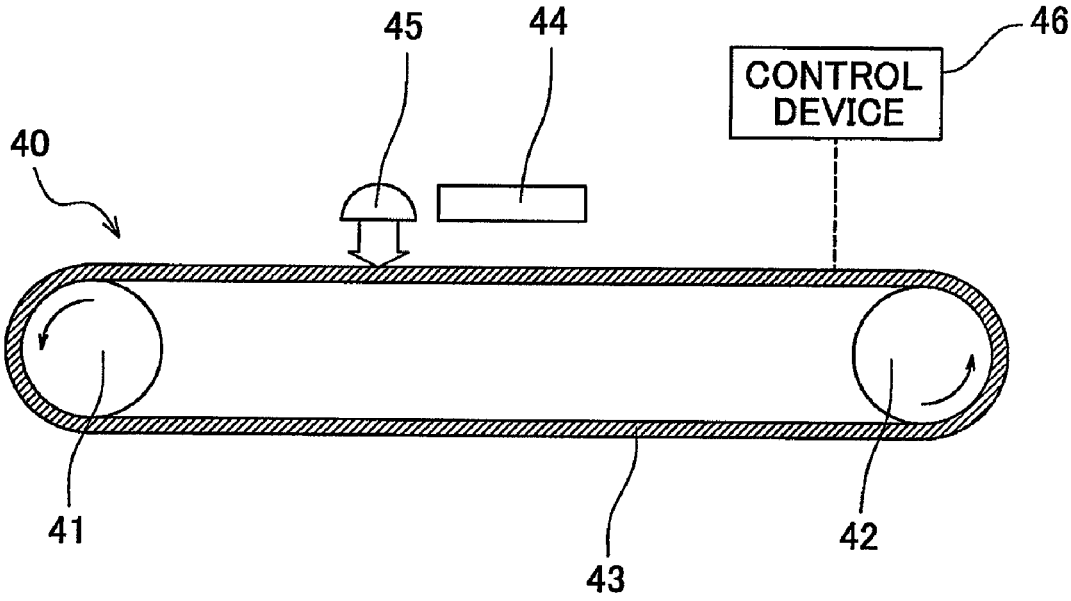
FIG. 9B is a schematic diagram of a printer in an ink curing mode in the modification 4.

In the meanwhile, when the ink curing mode is executed in the printer 40, as shown in FIG. 9B, the ultraviolet light applying apparatus 45 directly applies ultraviolet light onto the belt 43 when the ultraviolet light applying apparatus 45 does not oppose the record sheet P, e.g. when the record sheet P is not being conveyed. As a result the ink adhering to the belt 43 is cured (modification 4).

Also in this case, the ink which adheres to the belt 43 when printing on the record sheet P is carried out is cured and hence the ink does not adhere to the record sheet P.

In addition to the above, for example the printer 40 is arranged so that the rotation speed of the belt 43, i.e. the rotation speed of the conveyor rollers 41 and 42 is decreased when the ink curing mode is executed after the execution of the second print mode, as compared to the speed after the first print mode. Alternatively, the intensity of ultraviolet light is increased when the ink curing mode is executed after the execution of the second print mode, as compared to the intensity after the execution of the first print mode. With this, an amount of ultraviolet light applied from the ultraviolet light applying apparatus 45 to the belt 43 after the execution of the second liquid ejection mode is arranged to be larger than the amount after the execution of the first liquid ejection mode.

In other words, as the ink curing modes it is possible to execute a first ink curing mode in which ink adhering to the belt 43 as a result of the execution of the first print mode is cured and a second ink curing mode in which ink adhering to the belt 43 as a result of the execution of the second print mode is cured and an amount of light applied to the belt 43 is larger than the amount in the first ink curing mode.

Figure 10A:
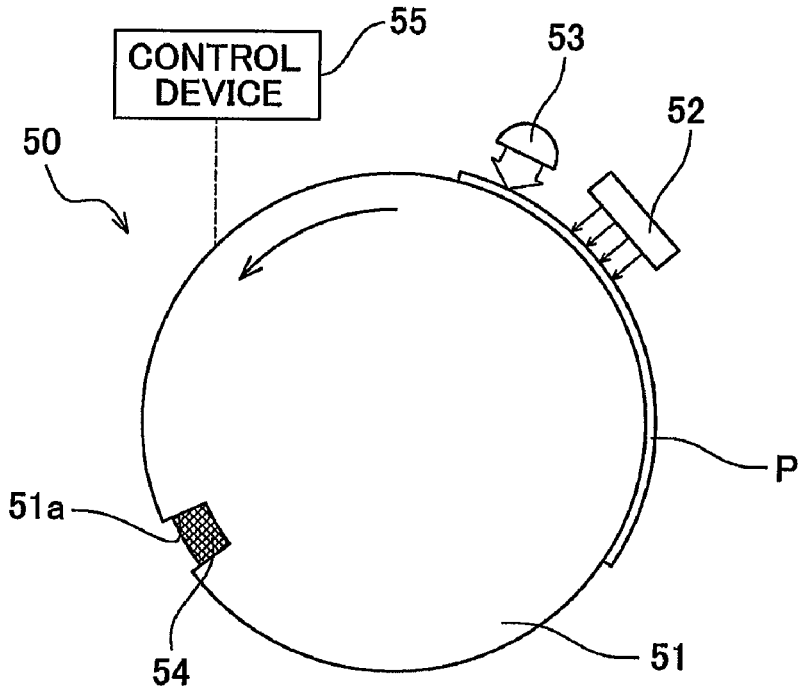
FIG. 10A is a schematic diagram of a printer in a print mode in a modification 5.
Figure 10B:
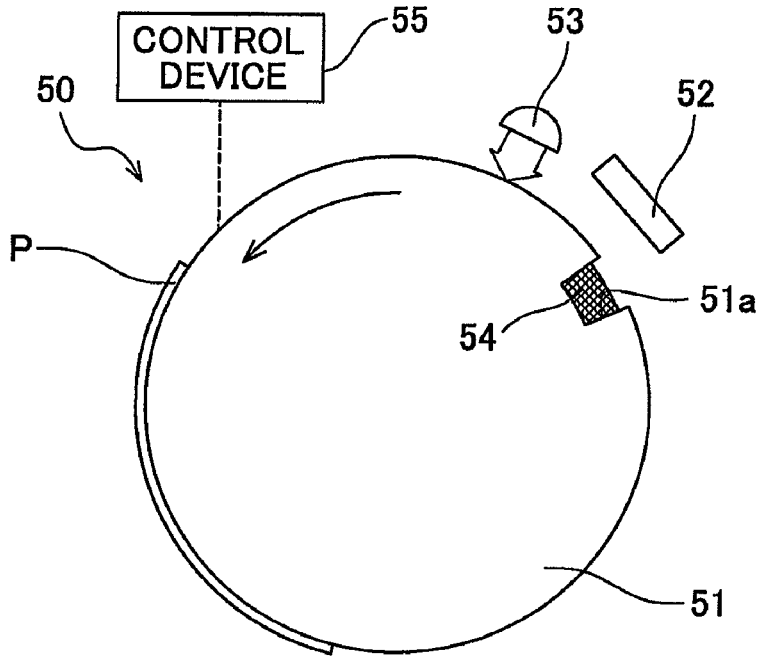
FIG. 10B is a schematic diagram of a printer in an ink curing mode in the modification 5.

In still another modification, as shown in FIGS. 10A and 10B, a printer 50 is arranged so that a drum 51 which is a supporting member substantially cylindrical in shape and extending in the direction orthogonal to the plane of FIGS. 10A and 10B rotates anticlockwise and hence a record sheet P supported by the surface of the drum 51 is conveyed anticlockwise. In addition, an inkjet head 52 is provided to oppose the outer surface of the drum 51 and an ultraviolet light applying apparatus 53 is provided to neighbor the inkjet head 52 on the downstream side in the anticlockwise rotation direction, and opposes the outer surface of the drum 51. The drum 51 has, at a part of its outer surface, an ink receiver 51*a* which receives ink ejected from the inkjet head 52 for flushing, and inside the ink receiver 51*a* provided is an ink absorber 54. This inkjet head 52 is a so-called line-type head which, in the direction orthogonal to the plane of FIGS. 10A and 10B, extends substantially as long as the record sheet P conveyed by the drum 51. The ultraviolet light applying apparatus 53 also extends substantially as long as the record sheet P in the direction orthogonal to the plane of FIGS. 10A and 10B.

The operation of the printer 50 is controlled by the control device 55. The control device 55 includes, in the same manner as the control device 20 (see FIG. 4), a mode determining unit 21, a head controller 23, an ultraviolet light application controller 24, a sheet conveyance controller 25, and the like. The head controller 23 controls the operation of the inkjet head 52, the ultraviolet light application controller 24 controls the operation of the ultraviolet light applying apparatus 53, and the sheet conveyance controller 25 controls the operation of the drum 51. It is possible in the printer 50 to execute a print mode in which printing on a record sheet P is carried out and an ink curing mode in which the ink adhering to the drum 51 is cured.

When the print mode is executed in the printer 50, the control device 55 performs control so that, as shown in FIG. 10A, the drum 51 is rotated so that the record sheet P provided on the drum 51 is conveyed. When the record sheet P reaches the position opposing the inkjet head 52, ink is ejected from the inkjet head 52 onto the record sheet P. When the recording sheet P reaches the position opposing the ultraviolet light applying apparatus 53, ultraviolet light is applied from the ultraviolet light applying apparatus 53 to the record sheet P. In this way printing on the record sheet P is carried out.

On the other hand, when the ink curing mode is executed in the printer 50, the control device 55 performs control so that, as shown in FIG. 10B, the ultraviolet light applying apparatus 53 directly applies ultraviolet light to the drum 51 when the ultraviolet light applying apparatus 53 does not oppose the record sheet P, e.g. when the record sheet P is not being conveyed by the drum 51. As a result the ink adhering to the drum 51 is cured. However, when the ink receiver 51*a* reaches the position opposing the ultraviolet light applying apparatus 53, the ultraviolet light applying apparatus 53 stops applying ultraviolet light in order to prevent the ink absorber 54 from receiving the ultraviolet light (modification 5).

Also in this case, the ink which adheres to the drum 51 during the printing onto the record sheet P is exposed to ultraviolet light and cured, and hence the ink on the drum 51 is not transferred to the record sheet P.

Furthermore, since the ink absorber 54 does not receive ultraviolet light, it is possible to avoid the aforesaid problem, namely the ink absorbed by the ink absorber 54 is cured and hence the absorber 54 cannot absorb ink any more.

In addition to the above, for example the printer 50 is arranged so that the rotation speed of the drum 51 is decreased when ultraviolet light is applied from the ultraviolet light applying apparatus 53 to the drum 51 after the execution of the second print mode, as compared to the speed after the first print mode. Alternatively, the intensity of ultraviolet light applied from the ultraviolet light applying apparatus 53 is increased when the ink curing mode is executed after the execution of the second print mode, as compared to the intensity after the execution of the first print mode. With this, an amount of ultraviolet light applied from the ultraviolet light applying apparatus 53 to the drum 51 after the execution of the second liquid ejection mode is arranged to be larger than the amount after the execution of the first liquid ejection mode.

In other words, as the ink curing modes it is possible to execute a first ink curing mode in which ink adhering to the drum 51 as a result of the execution of the first print mode is cured and a second ink curing mode in which ink adhering to the drum 51 as a result of the execution of the second print mode is cured and an amount of light applied to the drum 51 is larger than the amount in the first ink curing mode.

While the discussion above has described an example in which the present invention is used in a printer which carries out printing on a record sheet by ejecting UV-curable ink from an inkjet head to the record sheet supported by a platen, the present invention may also be used in a liquid ejection apparatus which ejects photo-curable liquid which is not ink onto an ejection target which is supported by a supporting member and is not a record sheet.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A liquid ejection apparatus comprising:

a liquid ejection head which ejects photo-curable liquid from a nozzle;

a supporting member which supports, from a side opposite to the liquid ejection head, an ejection target to which the liquid is ejected from the liquid ejection head;

a light applying apparatus which applies light for curing the liquid ejected from the liquid ejection head; and a control device which controls the liquid ejection head and the light applying apparatus, the control device controlling the liquid ejection head and the light applying apparatus to execute:

a liquid ejection mode in which the liquid is ejected from the liquid ejection head to the ejection target supported by the supporting member and the liquid on the ejection target is cured by application of the light from the light applying apparatus to the ejection target; and a liquid curing mode, executed after the liquid ejection mode, in which the light is directly applied from the light applying apparatus to at least a portion of the supporting member on which the ejection target was supported in the liquid ejection mode, such that the liquid adhering to the supporting member is cured.

2. The liquid ejection apparatus according to claim 1, further comprising:

a carriage which is controlled by the control device, supports the liquid ejection head and the light applying apparatus, and moves in a predetermined scanning direction while opposing the supporting member, wherein, the control device controls the liquid ejection head, the light applying apparatus, and the carriage, such that, in the liquid ejection mode, the liquid is ejected onto the ejection target supported by the supporting member while the liquid ejection head is moved in the scanning direction, and the light is applied to the ejection target while the light applying apparatus is moved in the scanning direction, and in the liquid curing mode, the light is directly applied onto the supporting member while the light applying apparatus is moved in the scanning direction.

3. The liquid ejection apparatus according to claim 1, wherein, the supporting member has a liquid receiver which receives the liquid ejected from the liquid ejection head, inside the liquid receiver, an absorber which is able to absorb the liquid is provided, and the control device controls the light applying apparatus, such that the light applying apparatus does not directly apply the light to the liquid receiver.

4. The liquid ejection apparatus according to claim 1, wherein, the supporting member has a liquid receiver which receives the liquid ejected from the liquid ejection head, the liquid receiver is connected to a waste tank which stores the liquid received by the liquid receiver, and the control device controls the light applying apparatus, such that the light applying apparatus does not directly apply the light onto the liquid receiver.

5. The liquid ejection apparatus according to claim 1, wherein, the control device controls the liquid ejection head and the light applying apparatus, such that, as the liquid ejection mode, a predetermined first liquid ejection mode and a second liquid ejection mode in which the liquid ejected from the liquid ejection head tends to adhere to the supporting member as compared to the first liquid ejection mode are executable, and the liquid curing mode is carried out more frequently when the second liquid ejection mode is executed than when the first liquid ejection mode is executed.

6. The liquid ejection apparatus according to claim 1, wherein, the control device controls the liquid ejection head and the light applying apparatus, such that, as the liquid ejection mode, a predetermined first liquid ejection mode and a second liquid ejection mode in which the liquid ejected from the liquid ejection head easily adheres to the supporting member as compared to the first liquid ejection mode are executable, as the liquid curing mode, a first liquid curing mode in which the liquid impacting onto the supporting member as a result of the first liquid ejection mode is cured and a second liquid curing mode in which the liquid impacting onto the supporting member as a result of the second liquid ejection mode is cured are executable, and an amount of the light applied from the light applying apparatus to the ejection target is larger in the second liquid curing mode than in the first liquid curing mode.

7. The liquid ejection apparatus according to claim 6, wherein, the second liquid curing mode is a mode in which a time for applying the light from the light applying apparatus to the supporting member is long as compared to the time for applying the light in the first liquid curing mode.

8. The liquid ejection apparatus according to claim 6, wherein, the second liquid curing mode is a mode in which the intensity of the light applied from the light applying apparatus to the supporting member is high as compared to the intensity of the light in the first liquid curing mode.

9. The liquid ejection apparatus according to claim 5, wherein, the first liquid ejection mode is a mode in which the liquid is ejected from the liquid ejection head to an area of the ejection target which area excludes a frame portion of the ejection target, and the second liquid ejection mode is a mode in which the liquid is ejected from the liquid ejection head to the entire ejection target including the frame portion.

10. The liquid ejection apparatus according to claim 5, wherein, the second liquid ejection mode is a mode in which the liquid is ejected from the liquid ejection head to the ejection target while a gap between the nozzle and the ejection target is arranged to be larger than the gap in the first liquid ejection mode.

11. The liquid ejection apparatus according to claim 5, wherein, the second liquid ejection mode is a mode in which the liquid is ejected from the liquid ejection head to the ejection target which is smaller in size than the ejection target in the first liquid ejection mode.

12. The liquid ejection apparatus according to claim 6, wherein, the first liquid ejection mode is a mode in which the liquid is ejected from the liquid ejection head to an area of the ejection target which area excludes a frame portion of the ejection target, and the second liquid ejection mode is a mode in which the liquid is ejected from the liquid ejection head to the entire ejection target including the frame portion.

13. The liquid ejection apparatus according to claim 6, wherein, the second liquid ejection mode is a mode in which the liquid is ejected from the liquid ejection head to the ejection target while a gap between the nozzle and the ejection target is arranged to be larger than the gap in the first liquid ejection mode.

14. The liquid ejection apparatus according to claim 6, wherein, the second liquid ejection mode is a mode in which the liquid is ejected from the liquid ejection head to the ejection target which is smaller in size than the ejection target in the first liquid ejection mode.

* * * * *